US006050269A

United States Patent [19]

Park

[11] Patent Number: 6,050,269

[45] Date of Patent: Apr. 18, 2000

[54] NAIL SCISSORS

[76] Inventor: Sam Wung Park, 134-17, Youngsoung-Dong, Chounan-City, Chungchoungnamdo, Rep. of Korea

[21] Appl. No.: 09/400,189

[22] Filed: Sep. 21, 1999

[51] Int. Cl.[7] ..... A45D 29/00; A45D 29/04; A45D 29/18; B26B 3/06

[52] U.S. Cl. ..... 132/73; 132/75.6; 132/76.4; 132/73.5; 30/155

[58] Field of Search ..... 132/73, 73.5, 75.3, 132/75.6, 75.5, 76.4; 30/155, 255, 151, 152

[56] References Cited

U.S. PATENT DOCUMENTS

| | | | |
|---|---|---|---|
| 1,383,556 | 7/1921 | Mothe | 132/75.6 |
| 1,702,226 | 2/1929 | Bruninghaus | 132/76.4 |
| 1,723,555 | 8/1929 | McCormack | 132/75.8 |
| 4,644,644 | 2/1987 | Eisholz | 30/28 |
| 5,331,739 | 7/1994 | Basangy | 30/28 |
| 5,745,997 | 5/1998 | Berg et al. | 30/155 |
| 5,813,417 | 9/1998 | Rudolph | 132/200 |
| 5,978,993 | 11/1999 | Rivera | 7/128 |

*Primary Examiner*—John J. Wilson
*Assistant Examiner*—Robyn Kien Doan
*Attorney, Agent, or Firm*—McDermott, Will & Emery

[57] ABSTRACT

Nail scissors are disclosed. The nail scissors have two blades. Each of the blades has a sharp edge at its front portion and a ring-shaped handle at its rear portion. The sharp edge is used to remove cuticles, while the ring-shaped handle provides a grip for fingers so as to operate the scissors. The blades is rotatably connected by a shaft. According to a feature of this invention, one of the blades is provided with an elliptical and longitudinal nail file portion at its exposed surface. One of the ring-shaped handles may be provided with a cuticle trimmer. The ring-shaped handles may be respectively provided with two parts of eyebrow tweezers, the parts of eyebrow tweezers respectively extending from the ends of the handles to a length and being inwardly and forwardly bent at their ends so as to squeeze each other at their ends.

3 Claims, 8 Drawing Sheets

NAIL SCISSORS

BACKGROUND OF THE INVENTION

1. Field of the Invention

The present invention relates, in general, to manicure implements and, more particularly, to nail scissors integrally formed with a nail file, a cuticle trimmer and eyebrow tweezers, a manicure implement being easily carried and stored, the use of the implement being convenient, the period of time for manicuring nails being reduced, and loss of component parts being prevented.

2. Description of the Prior Art

Conventionally, women are interested in and spend significant time manicuring their nails and cuticles prettily and cleanly. A manicure set for manicuring the nails and cuticles typically comprises nail scissors 1, a nail file 2, a cuticle trimmer 3 and eyebrow tweezers 4. That is, such a set includes multiple independent manicure implements.

In the use of the set, multiple independent manicure implements are used alternately pursuant to their uses so as to manicure the nails and cuticles. Therefore, such independent manicure implements are very troublesome and time-wasteful because a user has to use the independent implements alternately pursuant to their uses.

Additionally, in case that, as shown in FIG. 1, the independent manicure implements are carried in a manicure set case 5, the case 5 may not be easily carried because the case 5 is voluminous. Further, in case that the component implements are carried in a bag, such as a handbag, they may be difficult to carry as they add weight to the bag.

On the other hand, in the case wherein only some of the component implements are carried, complete manicuring is not carried out because sufficient manicure implements may not be provided.

Further more, manicure implements are easily lost because they are separate and small. When such loss occurs, sufficient manicure may not be carried out.

SUMMARY OF THE INVENTION

Accordingly, the present invention has been made keeping in mind the above problems occurring in the prior art, and an object of the present invention is to provide nail scissors integrally formed with a nail file, a cuticle trimmer and eyebrow tweezers, a manicure implement is easily carried and stored, the use of the implement is convenient, the period of time for manicuring nails and cuticles is reduced, and loss of component parts is prevented.

In order to accomplish the above object, the present invention provides nail scissors having two blades, each of the blades having a sharp edge at its front portion and a ring-shaped handle at its rear portion, the sharp edge being used to remove cuticles, the ring-shaped handle providing a grip for fingers so as to operate the scissors, the blades being rotatably connected by a shaft, wherein one of the blades is provided with an elliptical and longitudinal nail file portion at its exposed surface.

One of the ring-shaped handles may be provided with a cuticle trimmer.

The ring-shaped handles may be respectively provided with two parts of eyebrow tweezers, the parts of eyebrow tweezers respectively extending from the ends of the handles to a length and being inwardly and forwardly bent at their ends so as to squeeze each other at their ends.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
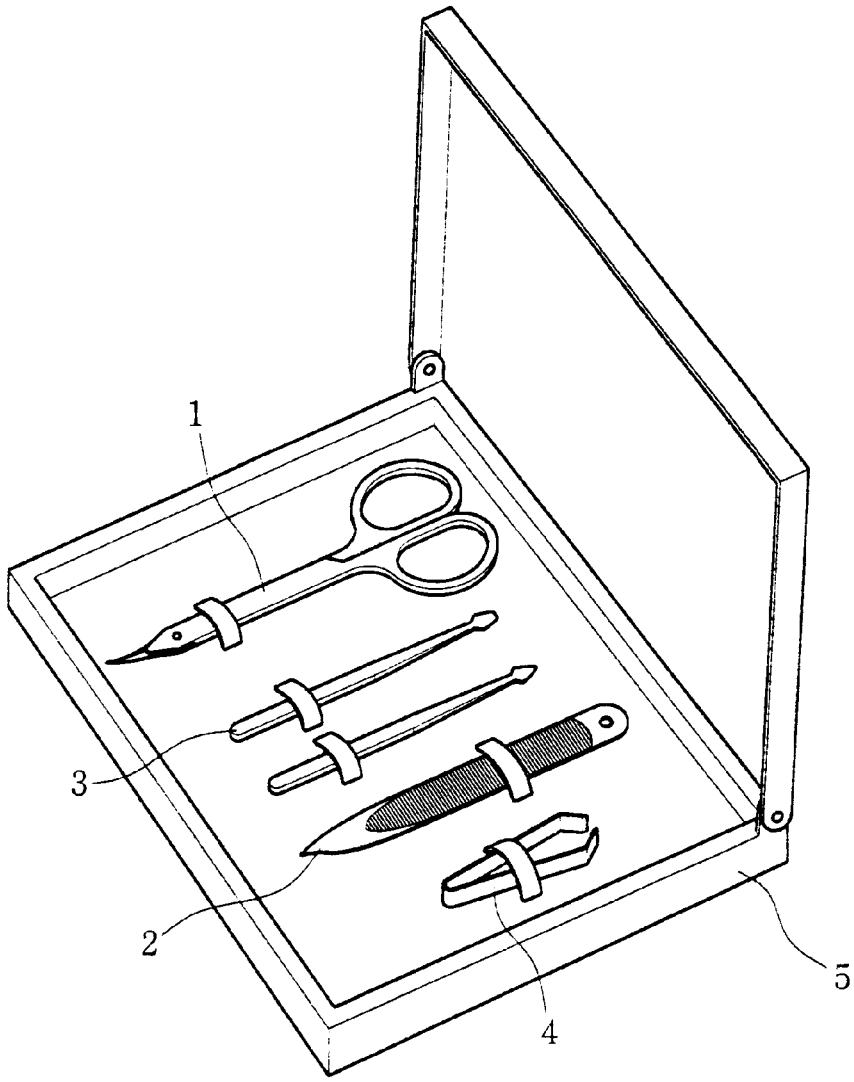
FIG. 1 (Prior art)
FIG. 1 is a perspective view, showing a conventional manicure set.
Figure 2:
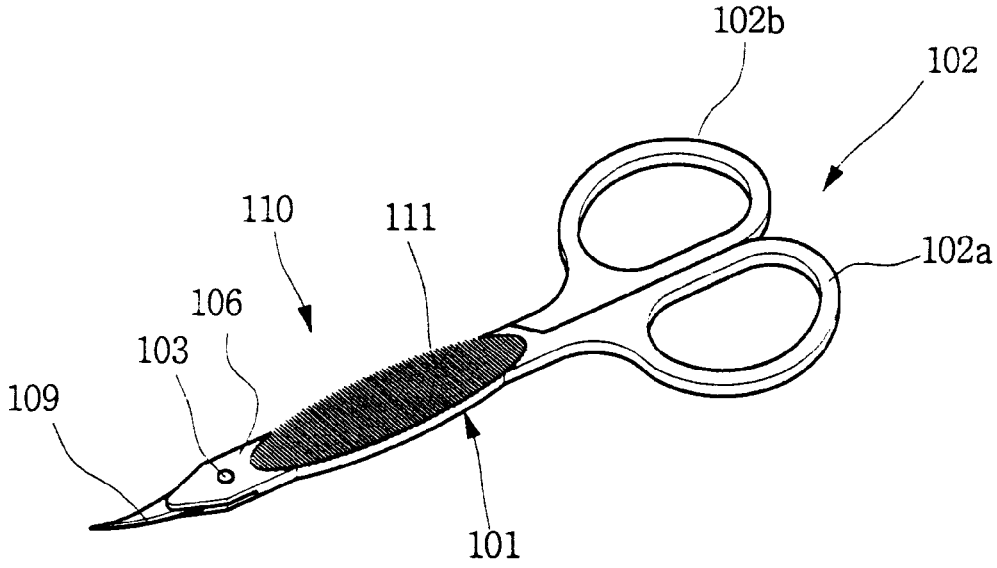
FIG. 2 is a perspective view, showing nail scissors according to a first embodiment of this invention.
Figure 3:
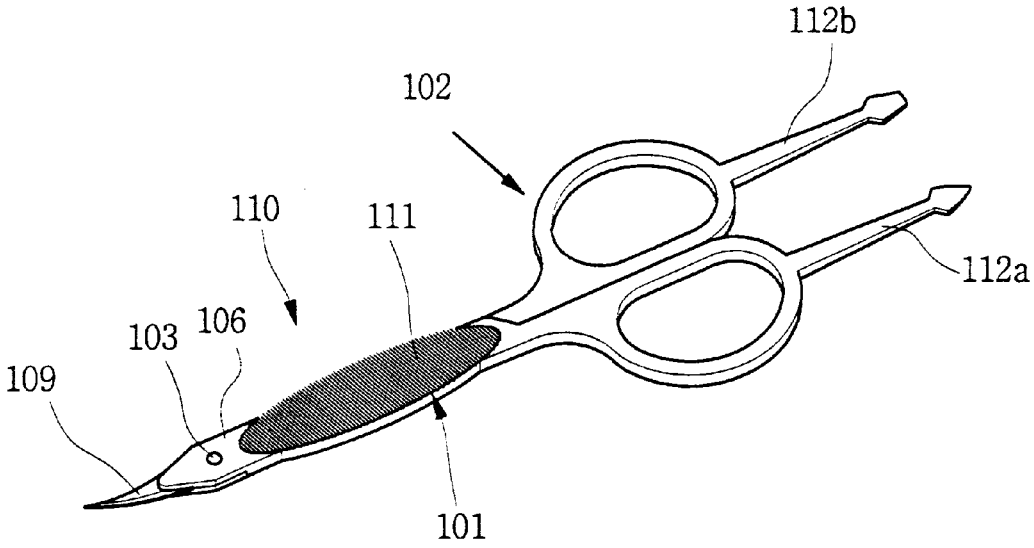
FIG. 3 is a perspective view, showing nail scissors according to a second embodiment of this invention.
Figure 4:
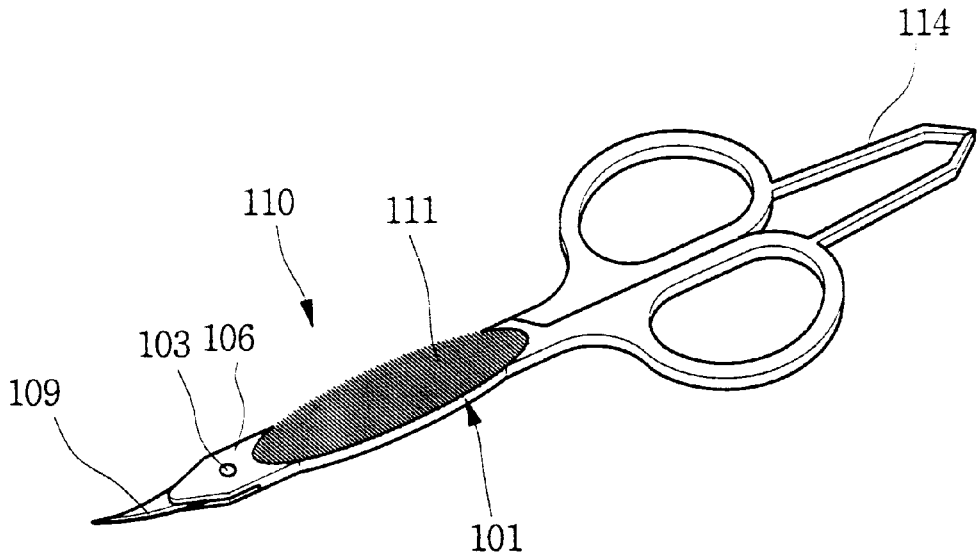
FIG. 4 is a perspective view, showing nail scissors according to a third embodiment of this invention.
Figure 5:
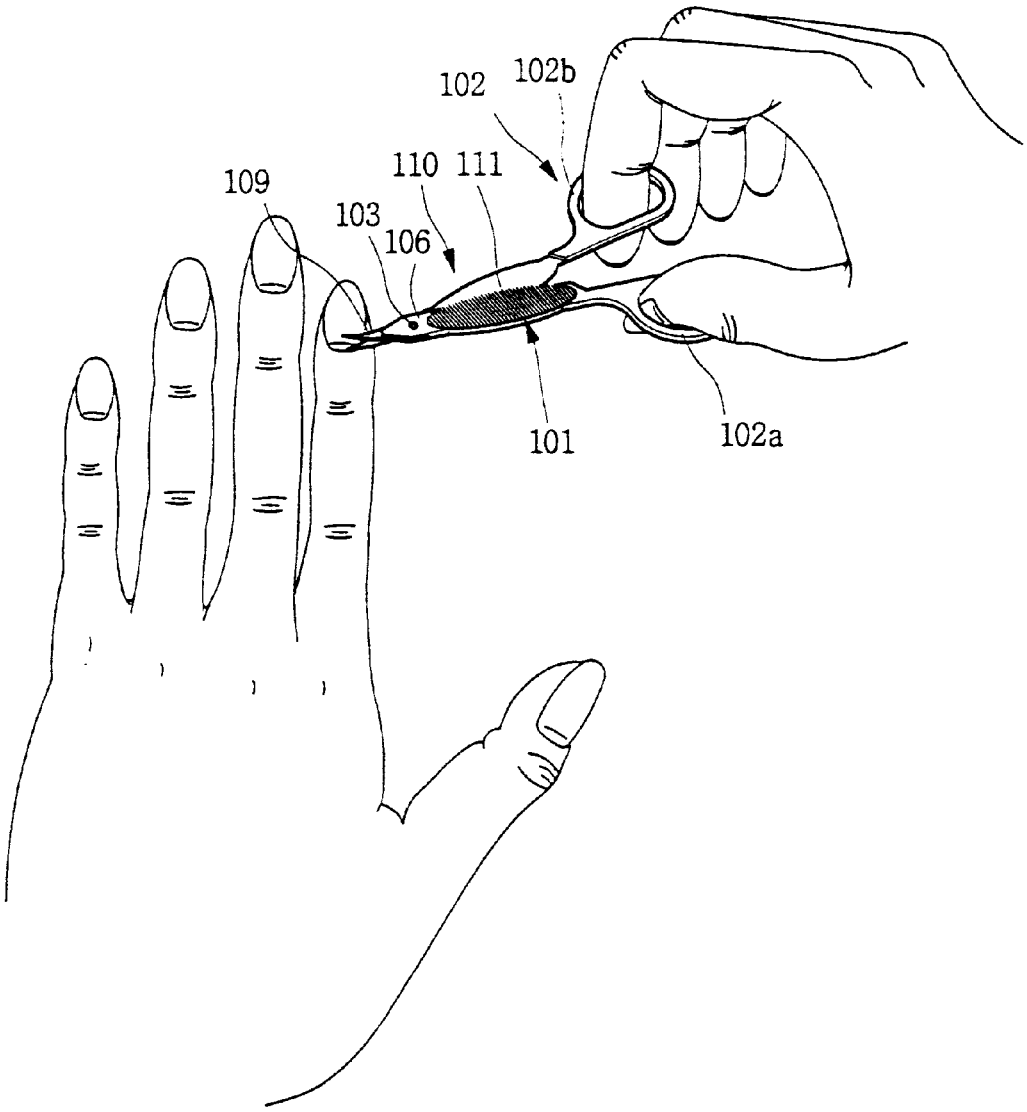
FIG. 5 is a perspective view, showing the nail scissors of FIG. 2 in use.
Figure 6:
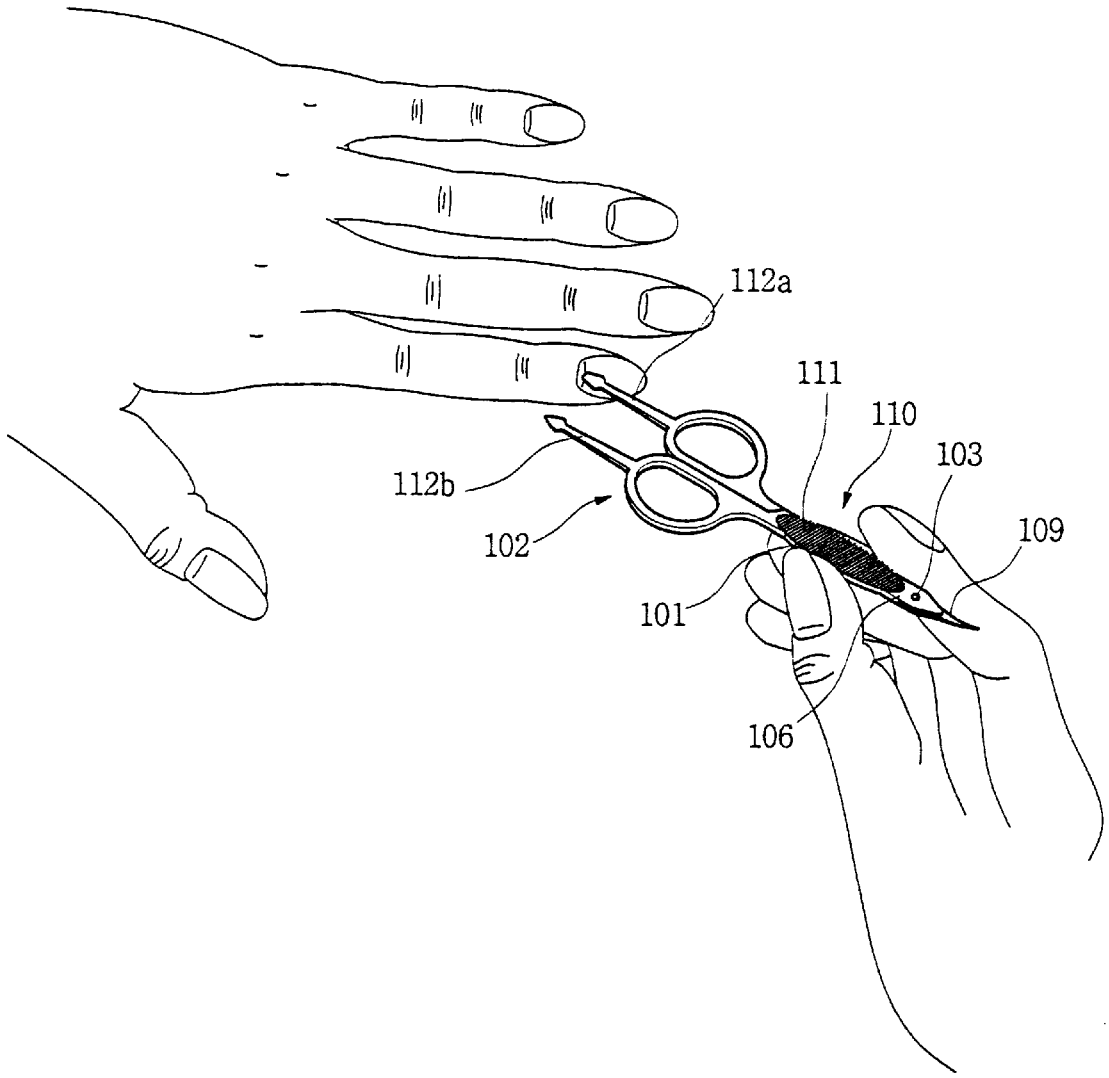
FIG. 6 is a perspective view, showing the nail scissors of FIG. 3 in use.

Referring to FIGS. 2–4, constitution of nail scissors according to the preferred embodiment of this invention is described in the following.

The nail scissors 110 comprises two blades 101. Each of the blades 101 has a sharp edge 109 at its front portion, while it has a ring-shaped handle 102 (102*a* or 102*b*) at its rear portion. The sharp edge 109 is used to remove cuticles, while the ring-shaped handle 102 provides a grip for fingers so as to operate the scissors. In order to be pivoted together, the blades 101 are rotatably connected by a shaft 103.

One of the blades 101 is provided with at least an elliptical and longitudinal nail file portion 111 at its exposed surface 106.

One of the ring-shaped handles 102 is provided with at least a cuticle trimmer 112.

The ring-shaped handles 102 are provided with two parts of eyebrow tweezers 114, respectively. The parts of eyebrow tweezers 114 extend from the ends of the handles 102 to a length and are inwardly and forwardly bent at the ends so as to squeeze each other at their ends when they are closed.

Hereinafter, operation of the embodiment is described.

When the nail scissors 110 of this embodiment are used as a scissors, two fingers, such as, the thumb and the index finger, or the thumb and the middle finger, are inserted into the holes of the ring-shaped handles 102, and the blades 101 are manipulated opened ans closed, alternately. Simultaneously, the blades 101 are so pivoted together on the shaft 103 as a center that their sharp edges 109 work one against the other, thereby cutting unnecessary cuticles about the nails by the action.

Figure 7:
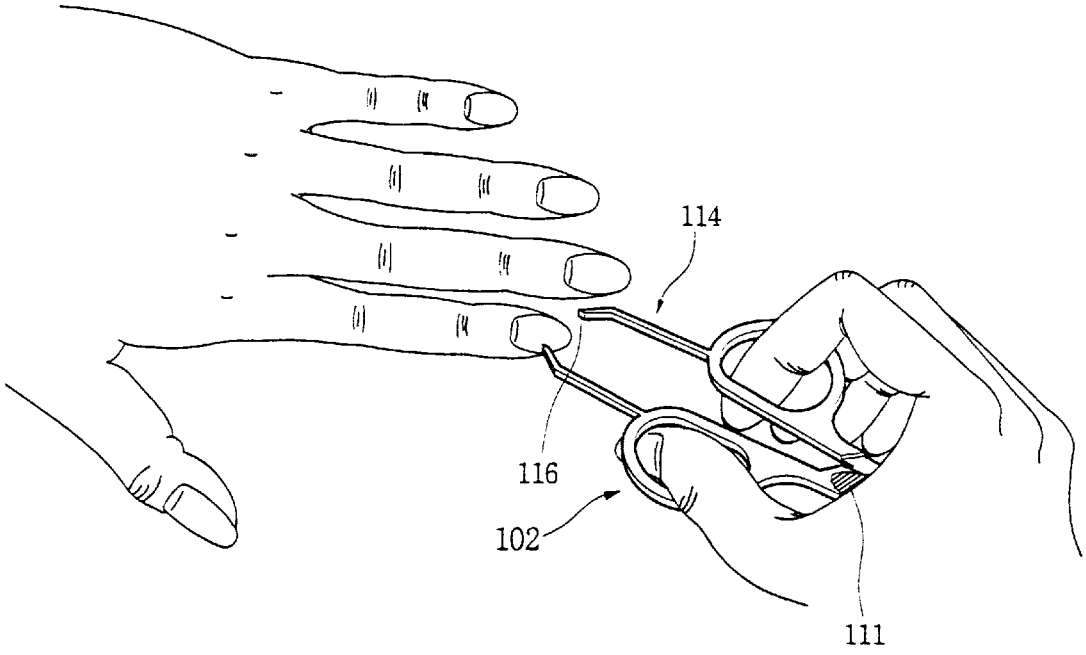
FIG. 7 is a perspective view, showing the nail scissors of FIG. 4 in use.

When stiff cuticles are desired to be removed, the cuticles are easily removed using the eyebrow tweezers 114 formed at the ends of the ring-shaped handles 102, as shown in FIG. 7. Additionally, hair, such as downy hair around eyebrows and legs, is easily removed in the same way. In case that the ends of the tweezers 114 are individually provided with an inclined surface 116, fine hair may be easily removed by the tweezers 114.

Figure 8:
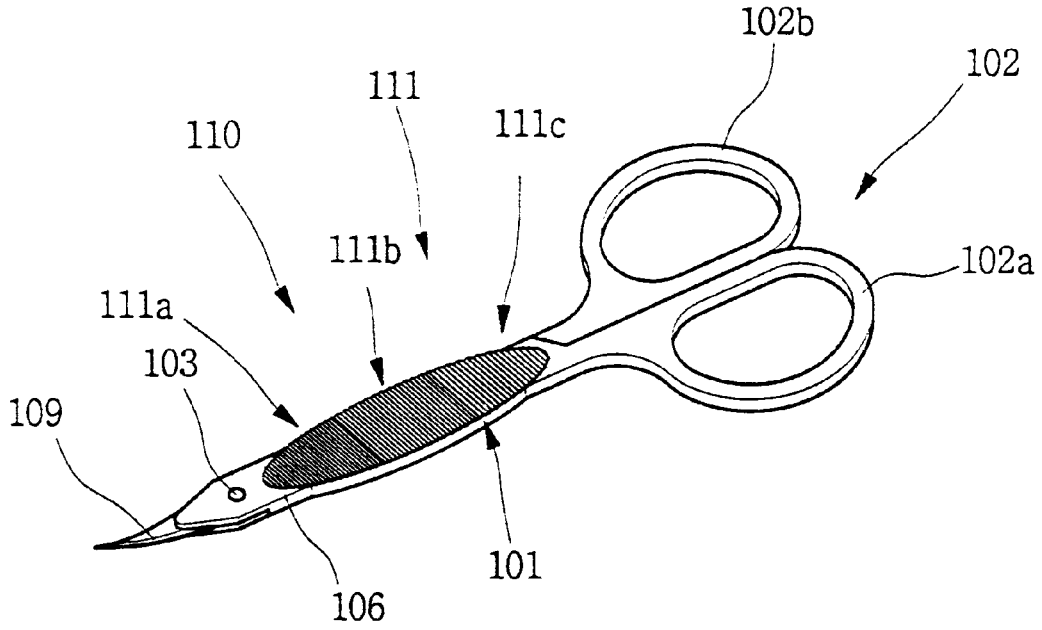
FIG. 8 is a perspective view, showing nail scissors according to a fourth embodiment of this invention.

Since one of the blades 101 is provided with at least an elliptical and longitudinal nail file portion 111, the ends of nails are smoothed by rubbing the rough ends of nails upon the file portion 111 after the nails are clipped. As shown in FIG. 8, the file portion 111 may be divided into three sub-portions, that is, an upper sub-portion 111*a*, a middle sub-portion 111*b* and a lower sub-portion 111*c*. A strong fingernail, such as the thumbnail, may be smoothed by the roughest upper sub-portion 111*a*, a hard fingernail, such as the nail of the index finger or the nail of the middle finger, may be smoothed by a rougher middle sub-portion 111*b*, and a relatively soft fingernail, such as the nail of the little finger, may be smoothed by the rough lower sub-portion 111*c*.

As a consequence, the period of time required for smoothing the nails may be reduced and the nails are more smoothly filed because a variety of file sub-portions may be selected according to the nail conditions, such as, the thickness of a nail and the trimmed state of a nail.

When trimming along the nail is required, a cuticle trimmer 112 may be used. The cuticle trimmer 112*a*, having a flat edge, is used to trim a wide and long portion, while the cuticle trimmer 112*a*, having a peaked edge, is used to trim a valley portion around the nail. Therefore, undesired cuticles are easily removed by the trimmer 112.

As a result, the nail scissors of this invention allows scissors, a nail file, a cuticle trimmer and eyebrow tweezers to be treated not separately, but as a whole. Therefore, a variety of manicure implements are immediately available while they are carried together.

As described above, since this invention provides nail scissors integrally formed with a nail file, a cuticle trimmer and eyebrow tweezers, a manicure implement is easily carried and stored, the use of the implement is convenient, the period of time for manicuring nails and cuticles is reduced, and loss of component parts is prevented.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Nail scissors having two blades, each of the blades having a sharp edge at its front portion and a ring-shaped handle at its rear portion, the sharp edge being used to remove cuticles, the ring-shaped handle providing a grip for fingers so as to operate the scissors, the blades being rotatably connected by a shaft, wherein one of the blades is provided with an elliptical and longitudinal nail file portion at its exposed surface.

2. The scissors according to claim 1, wherein one of said ring-shaped handles is provided with a cuticle trimmer.

3. The scissors according to claim 1, wherein said ring-shaped handles are respectively provided with two parts of eyebrow tweezers, the parts of eyebrow tweezers respectively extending from the ends of the handles to a length and being inwardly and forwardly bent at their ends so as to squeeze each other at their ends.

* * * * *